US011361705B2

(12) United States Patent
Lee et al.

(10) Patent No.: US 11,361,705 B2
(45) Date of Patent: Jun. 14, 2022

(54) DISPLAY DEVICE HAVING INTERLACED SCAN SIGNALS

(71) Applicant: Samsung Display Co., Ltd., Yongin-si (KR)

(72) Inventors: Kang Hee Lee, Yongin-si (KR); Deok Jun Choi, Yongin-si (KR); Woo Chui Kim, Yongin-si (KR); In Bok Song, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/037,245

(22) Filed: Sep. 29, 2020

(65) Prior Publication Data

US 2021/0110760 A1 Apr. 15, 2021

(30) Foreign Application Priority Data

Oct. 10, 2019 (KR) ..... 10-2019-0125414

(51) Int. Cl.
*G09G 3/30* (2006.01)
*G09G 3/32* (2016.01)

(52) U.S. Cl.
CPC ..... *G09G 3/32* (2013.01); *G09G 2310/08* (2013.01); *G09G 2320/0626* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 7,710,377 | B2 | 5/2010 | Kang et al. | |
| 8,624,804 | B2 | 1/2014 | Ryu et al. | |
| 2008/0150846 | A1* | 6/2008 | Chung | G09G 3/3233 345/80 |
| 2009/0128466 | A1* | 5/2009 | Chung | G09G 3/3688 345/87 |
| 2013/0069854 | A1* | 3/2013 | Park | G09G 3/3233 345/82 |

(Continued)

FOREIGN PATENT DOCUMENTS

| | | | |
|---|---|---|---|
| JP | 3516382 | B2 | 4/2004 |
| KR | 10-0688498 | B1 | 3/2007 |
| KR | 10-1589863 | B1 | 1/2016 |

*Primary Examiner* — Am A Awad
*Assistant Examiner* — Donna V Bocar
(74) *Attorney, Agent, or Firm* — Lewis Roca Rothgerber Christie LLP

(57) ABSTRACT

A display device includes: a plurality of pixels arranged in a row direction and a column direction; a data driver configured to transmit a data signal to the plurality of pixels through a plurality of data lines; a scan driver configured to transmit a scan signal to the plurality of pixels through a plurality of scan lines; and a light emission driver configured to transmit a light emission signal to the plurality of pixels through a plurality of light emission lines, wherein each of the scan lines and the light emission lines is connected to the pixels arranged in the row direction among the plurality of pixels, the data lines are connected to the pixels arranged in the column direction among the plurality of pixels, and the scan driver is configured to transmit the scan signal of a turn-on level to the pixels in an interlace manner.

17 Claims, 13 Drawing Sheets

(56) References Cited

U.S. PATENT DOCUMENTS

| | | | | |
|---|---|---|---|---|
| 2014/0146028 | A1* | 5/2014 | Choi | G09G 3/3225 345/212 |
| 2014/0285542 | A1* | 9/2014 | Izumi | G09G 3/3233 345/694 |
| 2014/0375622 | A1 | 12/2014 | Nakagawa et al. | |
| 2015/0187292 | A1* | 7/2015 | Kim | G09G 3/3614 345/88 |
| 2016/0321977 | A1* | 11/2016 | Kong | G09G 3/2003 |
| 2017/0047011 | A1* | 2/2017 | Yoon | G09G 3/3233 |
| 2019/0164498 | A1* | 5/2019 | Jang | G09G 3/3266 |

* cited by examiner

DISPLAY DEVICE HAVING INTERLACED SCAN SIGNALS

CROSS-REFERENCE TO RELATED APPLICATION

This application claims priority to and the benefit of Korean Patent Application No. 10-2019-0125414, filed on, Oct. 10, 2019, the content of which in its entirety is herein incorporated by reference.

BACKGROUND

1. Field

Aspects of some example embodiments of the present disclosure relate to a display device.

2. Description of the Related Art

An electroluminescent display device may generally be categorized as an inorganic light emitting display device or an organic light emitting display device depending on the material of the light emitting layer. An organic light emitting display device of an active matrix type includes an organic light emitting diode (hereinafter referred to as an "OLED") that emits light by itself, and has characteristics such a relatively fast response speed, and relatively efficient light emission characteristics, and an improved luminance and viewing angle compared to other display devices.

A driving circuit of a flat panel display device generally includes a data driving circuit that supplies a data signal to data lines, and a scan driving circuit that supplies a gate signal (or a scan signal) to gate lines (or scan lines). The scan driving circuit may be directly formed on the same substrate together with circuit elements of an active area corresponding to the screen. The circuit elements of the active area correspond to a pixel circuit formed in each of pixels arranged in a matrix configuration by the data lines and the scan lines of a pixel array. Each of the circuit elements in the active area and the scan driving circuit includes a plurality of transistors.

Digital flat panel display devices may write a data signal to pixels in a progressive manner. The progressive manner sequentially writes the data signals to all rows (pixel rows) of the active area during a vertical active period of one frame period. For example, after concurrently (e.g., simultaneously) writing the data signals to pixels of a first row, the data signals are concurrently (e.g., simultaneously) written to pixels of a second row, and then the data signals are concurrently (e.g., simultaneously) written to pixels of a third row. In this manner, the data signals are sequentially written to pixels of all rows of a display panel. In order to implement such a progressive writing, a gate-in-panel (GIP) circuit may shift an output using a shift register to sequentially supply the gate signals to the gate lines.

The above information disclosed in this Background section is only for enhancement of understanding of the background and therefore the information discussed in this Background section does not necessarily constitute prior art.

SUMMARY

Aspects of some example embodiments of the disclosure include a display device capable of reducing power consumption.

The characteristics of embodiments according to the present disclosure are not limited to the above-described characteristics, and other technical characteristics that are not specifically described will be more clearly understood by those skilled in the art from the following description.

A display device according to some example embodiments includes: a display panel including a plurality of pixels arranged in a row direction and a column direction, a data driver configured to transmit a data signal to the plurality of pixels through a plurality of data lines, a scan driver configured to transmit a scan signal to the plurality of pixels through a plurality of scan lines, and a light emission driver configured to transmit a light emission signal to the plurality of pixels through a plurality of light emission lines. Each of the scan lines and the light emission lines is connected to the pixels arranged in the row direction among the plurality of pixels, the data lines are connected to the pixels arranged in the column direction among the plurality of pixels, and the scan driver transmits the scan signal of a turn-on level to the display panel in an interlace manner.

According to some example embodiments, the light emission driver may transmit the light emission signal of a turn-off level to the pixels arranged in the row direction, and the scan signal of the turn-on level may be transmitted to the pixels arranged in the row direction while the transmission of the light emission signal of the turn-off level is maintained.

According to some example embodiments, the light emission driver may transmit the light emission signal of the turn-off level in an interlace manner.

According to some example embodiments, a period in which the transmission of the light emission signal of the turn-off level is maintained in each of the pixels may be three times or more than a period in which the scan signal of the turn-on level is maintained.

According to some example embodiments, the scan signal of the turn-on level may be provided in an order of pixels arranged in a first row, pixels arranged in a third row, pixels arranged in a second row, and pixels arranged in a fourth row, among the plurality of pixels.

According to some example embodiments, the light emission signal of the turn-off level may be provided in an order of the pixels arranged in the first row, the pixels arranged in the third row, the pixels arranged in the second row, and the pixels arranged in the fourth row, among the plurality of pixels.

According to some example embodiments, red pixels and blue pixels may be connected to one data line among the plurality of data lines, and the red pixels and the blue pixels may alternate in the column direction.

According to some example embodiments, green pixels may be connected to another data line among the plurality of data lines.

According to some example embodiments, the data driver may successively transmit the data signal to at least two red pixels or at least two blue pixels connected to the one data line.

According to some example embodiments, the data driver may transmit swinging data signals of different levels to the one data line, and the data signals of the different levels may swing less than half of the number of rows of the plurality of pixels per one frame.

According to some example embodiments, the scan driver may include a plurality of scan stages connected to a scan start line and each of the scan lines, and each of the scan stages may supply the scan signal of the turn-on level to the pixels connected to each of the scan lines in response to a scan start signal provided to the scan start line.

According to some example embodiments, the plurality of scan stages may include a first scan stage connected to pixels arranged in a first row among the plurality of pixels through a first scan line, a second scan stage connected to pixels arranged in a second row among the plurality of pixels through a second scan line, and a third scan stage connected to pixels arranged in a third row among the plurality of pixels through a third scan line, and the third scan stage may be connected to a scan start line branched from the first scan line.

According to some example embodiments, the second scan stage may be connected to a scan start line branched from the third scan line.

According to some example embodiments, the light emission driver may transmit the light emission signal of the turn-off level in a progressive manner.

A display device according to some example embodiments includes one data line, a plurality of red pixels and a plurality of blue pixels connected to the one data line, and scan lines connected to the plurality of red pixels and the plurality of blue pixels to provide a scan signal, and light emission lines for providing a light emission signal. The red pixel and the blue pixel are alternately arranged along the one data line, and the scan signal is successively provided to at least two red pixels.

According to some example embodiments, the scan signals successively provided to the at least two red pixels may not overlap in time.

According to some example embodiments, the light emission signals provided to the at least two red pixels may overlap at least partially in time.

According to some example embodiments, the light emission signals provided to the at least two red pixels may be successively provided.

According to some example embodiments, each of the pixels may include seven transistors, a storage capacitor, and a light emitting diode.

According to some example embodiments, the scan signal may be successively provided to the at least two red pixels, and then successively provided to at least two blue pixels.

Further details of some example embodiments are included in the detailed description and drawings.

According to some example embodiments of the disclosure, the display device may reduce power consumption.

The characteristics of the embodiments are not limited by the details illustrated above, more various characteristics are further illustrated and described in the present specification.

BRIEF DESCRIPTION OF THE DRAWINGS

The above and other characteristics of the disclosure will become more apparent by describing in further detail example embodiments thereof with reference to the accompanying drawings, in which.

DETAILED DESCRIPTION

Figure 1:
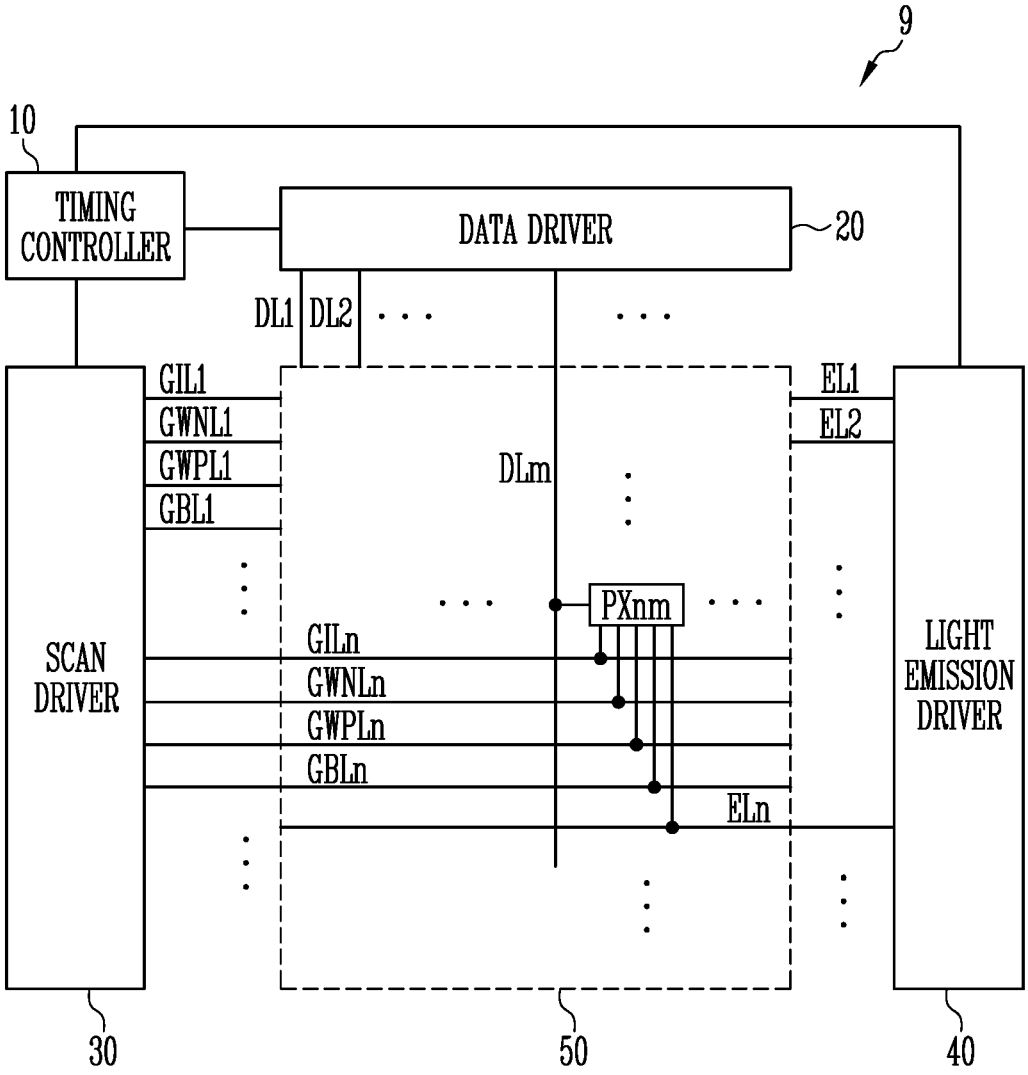
FIG. 1 is a block diagram schematically illustrating a display device according to some example embodiments of the disclosure.

The characteristics and features of the disclosure and a method of achieving them will become more apparent with reference to the embodiments described in more detail below together with the accompanying drawings. However, the disclosure is not limited to the example embodiments disclosed below, and may be implemented in various different forms. The present example embodiments are provided so that the disclosure will be more thorough and more complete and those skilled in the art to which the disclosure pertains can fully understand the scope of the disclosure. Embodiments according to the disclosure are defined by the scope of the claims and their equivalents.

Although a first, a second, and the like are used to describe various components, it goes without saying that these components are not limited by these terms. These terms are used only to distinguish one component from another component. Therefore, it goes without saying that a first component mentioned below may be a second component within the technical spirit of the disclosure. The singular expressions include plural expressions unless the context clearly dictates otherwise.

The following example embodiments may be applied to various display devices such as an organic light emitting display device, a liquid crystal display device, a field emission display device, and an electrophoretic device.

Hereinafter, example embodiments of the disclosure will be described in more detail with reference to the accompanying drawings. The same or similar reference numerals are used for the same components in the drawings.

Figure 2:
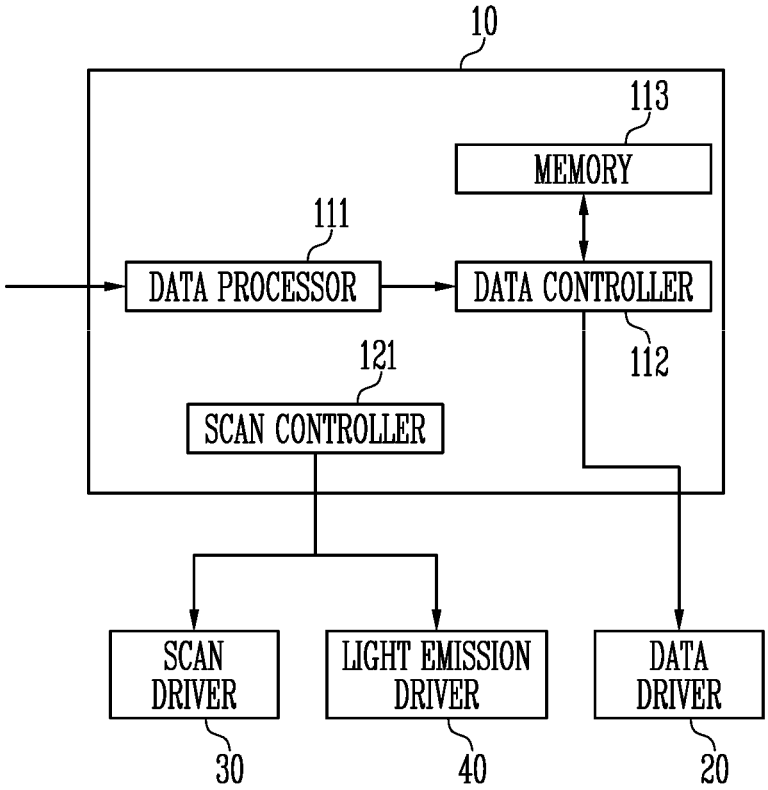
FIG. 2 is a block diagram schematically illustrating a relationship between a timing controller, a data driver, a scan driver, and a light emission driver in the display device according to some example embodiments of the disclosure.

FIG. 1 is a block diagram schematically illustrating a display device according to some example embodiments of the disclosure. FIG. 2 is a block diagram schematically illustrating a relationship between a timing controller, a data driver, a scan driver, and a light emission driver in the display device according to some example embodiments of the disclosure.

Referring to FIGS. 1 and 2, the display device 9 according to some example embodiments may include the timing controller 10, the data driver 20, the scan driver 30, the light emission driver 40, and a pixel unit (or display panel) 50.

The timing controller 10 may receive an external input signal from an external processor. The external input signal may include a vertical synchronization signal, a horizontal synchronization signal, a data enable signal, an RGB data signal, and the like.

The vertical synchronization signal may include a plurality of pulses and may indicate that a previous frame period has ended and a current frame period has started based on a time point at which each of pulses is generated. An interval between adjacent pulses of the vertical synchronization signal may correspond to one frame period. The horizontal synchronization signal Hsync (refer to FIG. 5) may include a plurality of pulses and may indicate that a previous horizontal period has ended and a new horizontal period has started based on a time point at which each of the pulses is generated. An interval between adjacent pulses of the horizontal synchronization signal may correspond to one horizontal period 1H (refer to FIG. 5). The data enable signal may have an enable level with respect to specific horizontal periods and may have a disable level in the remaining periods.

When the data enable signal is the enable level, the data enable signal may indicate that the RGB data signal is supplied in corresponding horizontal periods. The RGB data signal may be supplied in a pixel row unit in each of corresponding horizontal periods. The timing controller 10 may generate grayscale values based on the RGB data signal to correspond to a specification of the display device 9. The timing controller 10 may generate control signals to be supplied to the data driver 20, the scan driver 30, the light emission driver 40, and the like based on the external input signal according to the design and specifications of the display device 9.

The timing controller 10 may include a data processor 111, a data controller 112, a memory 113, and a scan controller 121. According to some example embodiments, a form in which the data processor 111, the data controller 112, the memory 113, and the scan controller 121 are merged into the timing controller 10 will be described as an example. However, the data processor 111, the data controller 112, the memory 113, and the scan controller 121 may be located outside the timing controller 10.

The scan controller 121 may generate a gate timing control signal for controlling an operation timing of the scan driver 30 and the light emission driver 40 based on the vertical synchronization signal, the horizontal synchronization signal, a dot clock signal, and the data enable signal. The gate timing control signal may include a gate start pulse, a gate shift clock, and the like, but embodiments are not limited thereto. The gate start pulse is applied to a scan or light emission stage that generates a first output to activate an operation of the scan or light emission stage. The gate shift clock is a clock signal that is commonly input to the scan or light emission stages and is a clock signal for shifting the gate start pulse.

The data processor 111 generates compensation data by adding a preset compensation value to the data controller 112. The data processor 111 may sense an electrical characteristic of each of the pixels PXnm, derive a compensation value of the pixel PXnm that compensates for an electrical characteristic variation between the pixels PXnm, for example, a threshold voltage variation of driving transistors, based on the sensing result, and may store the compensation value of the pixel PXnm in the memory 113 or update a previously stored value. The memory 113 may be a flash memory, but is not limited thereto.

The data controller 112 may generate a data timing control signal for controlling an operation timing of the data driver 20. The data timing control signal may include a source start pulse, a source sampling clock, a data enable signal, and the like, but embodiments are not limited thereto.

The data driver 20 may generate data voltages to be provided to data lines DL1, DL2, and DLm using the grayscale values and the control signals received from the data controller 112. For example, the data driver 20 may sample the grayscale values using a clock signal, and may provide the data voltages corresponding to the grayscale values to the data lines DL1, DL2, and DLm in the pixel row unit (for example, pixels connected to the same scan line.

The scan driver 30 may receive the clock signal, the scan start signal, and the like from the timing controller 10 to generate scan signals to be provided to scan lines GIL1, GWNL1, GWPL1, GBL1, GILn, GWNLn, GWPLn, and GBLn. Here, n may be an integer greater than zero.

The scan driver 30 may include a plurality of sub scan drivers. For example, a first sub scan driver may provide the scan signals for the scan lines GIL1 and GILn, a second sub scan driver may provide the scan signals for the scan lines GWNL1 and GWNLn, a third sub scan driver may provide the scan signals for the scan lines GWPL1 and GWPLn, and a fourth sub scan driver may provide the scan signals for the scan lines GBL1 and GBLn. Each of the sub scan drivers may include a plurality of scan stages connected in an arrangement or circuit structure to form a shift register. For example, the scan signals may be generated in such a manner that a pulse of a turn-on level of the scan start signal supplied to the scan start line is transferred to another scan stage.

For another example, the first and second sub scan drivers may be integrated to provide scan signals for the scan lines GIL1, GWNL1, GILn, and GWNLn, and the third and fourth sub scan drivers may be integrated to provide scan signals for the scan lines GWPL1, GBL1, GWPLn, and GBLn. For example, a previous scan line (that is, an (n−1)-th scan line) of an n-th scan line GWNLn may be connected to the same electrical node as the n-th scan line GILn. In addition, for example, a next scan line (that is, an (n+1)-th scan line) of the n-th scan line GWPLn may be connected to the same electrical node as the n-th scan line GBLn.

At this time, the first and second sub scan drivers may supply scan signals having pulses of a first polarity to the scan lines GIL1, GWNL1, GILn, and GWNLn. In addition, the third and fourth sub scan drivers may supply scan signals having pulses of a second polarity to the scan lines GWPL1, GBL1, GWPLn, and GBLn. The first polarity and the second polarity may be opposite polarities to each other. According to some example embodiments, all of the scan lines GIL1, GWNL1, GILn, GWNLn, GWPL1, GBL1, GWPLn, and GBLn may have one polarity.

Hereinafter, the polarity may mean a logic level of a pulse. For example, when the pulse is the first polarity, the pulse may have a high level. At this time, the pulse of the high level may be referred to as a rising pulse. When the rising pulse is supplied to a gate electrode of an N-type transistor, the N-type transistor may be turned on. That is, the rising pulse may be a turn-on level with respect to the N-type transistor. Here, it is assumed that a voltage of a level sufficiently lower than that of a voltage applied to a gate electrode of the N-type transistor is applied to a source electrode of the N-type transistor. For example, the N-type transistor may be an NMOS.

In addition, when the pulse is a second polarity, the pulse may have a low level. At this time, the pulse of the low level may be referred to as a falling pulse. When the falling pulse is supplied to a gate electrode of a P-type transistor, the P-type transistor may be turned on. That is, the falling pulse may be a turn-on level with respect to the P-type transistor. Here, it is assumed that a voltage of a level sufficiently higher than that of a voltage applied to a gate electrode of the P-type transistor is applied to a source electrode of the P-type transistor. For example, the P-type transistor may be a PMOS.

The light emission driver 40 may receive a clock signal, a light emission off signal, and the like from the timing controller 10 to generate light emission signals to be provided to the light emission lines EL1, EL2, and ELn. For example, the light emission driver 40 may provide light emission signals having a pulse of a turn-off level to the light emission lines EL1, EL2, and ELn. For example, the light emission driver 40 may be configured in a form of a shift register, and may generate the light emission signals in such a manner that a pulse of a turn-off level of the light emission off signal is transferred to another light emission stage according to control of the clock signal.

The pixel unit 50 includes the pixels PXnm. For example, the pixel PXnm may be connected to corresponding data line DLm, scan lines GILn, GWNLn, GWPLn, and GBLn, and light emission line ELn.

Figure 3:
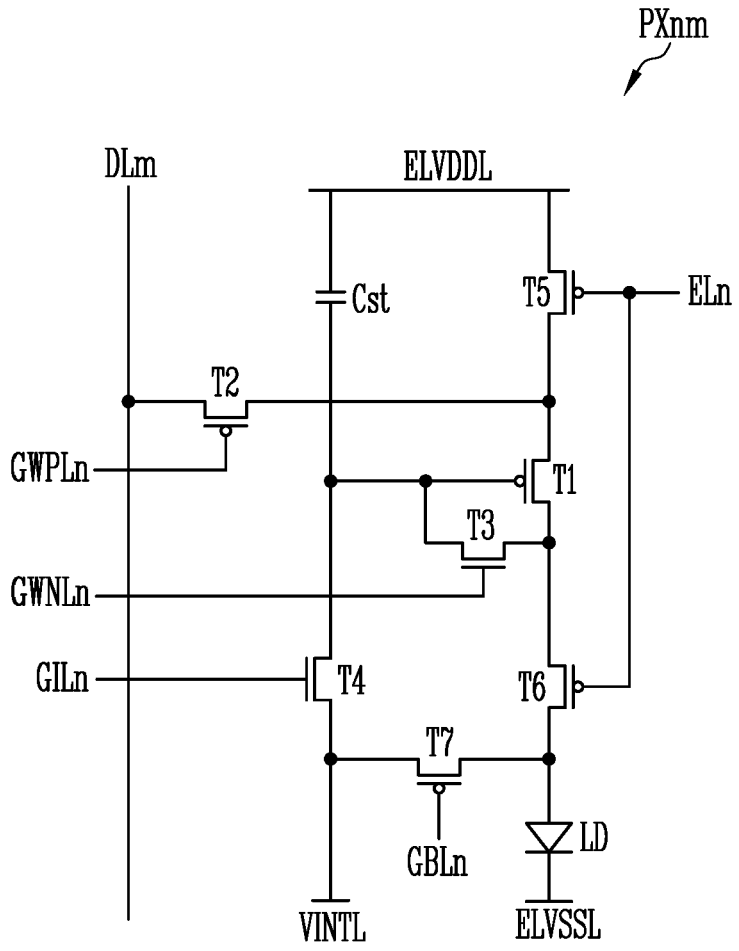
FIG. 3 is an equivalent circuit diagram of a pixel according to some example embodiments of the disclosure.

FIG. 3 is an equivalent circuit diagram of the pixel according to some example embodiments of the disclosure.

Referring to FIG. 3, the pixel PXnm according to some example embodiments of the disclosure includes transistors T1, T2, T3, T4, T5, T6, and T7, a storage capacitor Cst, and a light emitting diode LD. Embodiments according to the present invention are not necessarily limited to the structure of the pixel circuit illustrated in FIG. 3, however, and some example embodiments may include additional or fewer transistors, or capacitors, or other electrical components without departing from the spirit and scope of embodiments according to the present disclosure.

A first electrode of the transistor T1 may be connected to a first electrode of the transistor T2, a second electrode of the transistor T1 may be connected to a first electrode of the transistor T3, and a gate electrode of the transistor T1 may be connected to a second electrode of the transistor T3. The transistor T1 may also be referred to as a driving transistor.

A first electrode of the transistor T2 may be connected to the first electrode of the transistor T1, a second electrode of the transistor T2 may be connected to the data line DLm, and a gate electrode of the transistor T2 may be connected to the scan line GWPLn. The transistor T2 may also be referred to as a scan transistor.

A first electrode of the transistor T3 may be connected to the second electrode of the transistor T1, the second electrode of the transistor T3 may be connected to the gate electrode of the transistor T1, and a gate electrode of the transistor T3 may be connected to the scan line GWNLn. The transistor T3 may also be referred to as a diode connection transistor.

A first electrode of the transistor T4 may be connected to a second electrode of the capacitor Cst, a second electrode of the transistor T4 may be connected to an initialization line VINTL, and a gate electrode of the transistor T4 may be connected to the scan line GILn. The transistor T4 may be referred to as a gate initialization transistor.

A first electrode of the transistor T5 may be connected to a power line ELVDDL, a second electrode of the transistor T5 may be connected to the first electrode of the transistor T1, and a gate electrode of the transistor T5 may be connected to the light emission line ELn. The transistor T5 may be referred to as a first light emission transistor.

A first electrode of the transistor T6 may be connected to the second electrode of the transistor T1, a second electrode of the transistor T6 may be connected to an anode of the light emitting diode LD, and a gate electrode of the transistor T6 may be connected to the light emission line ELn. The transistor T6 may be referred to as a second light emission transistor.

A first electrode of the transistor T7 may be connected to the anode of the light emitting diode LD, a second electrode of the transistor T7 may be connected to the initialization line VINTL, and a gate electrode of the transistor T7 may be connected to the scan line GBLn. The transistor T7 may be referred to as an anode initialization transistor.

A first electrode of the storage capacitor Cst may be connected to the power line ELVDDL and the second electrode of the storage capacitor Cst may be connected to the gate electrode of the transistor T1.

The anode of the light emitting diode LD may be connected to the second electrode of the transistor T6, and a cathode of the light emitting diode LD may be connected to the power line ELVSSL. A voltage applied to the power line ELVSSL may be set to be lower than a voltage applied to the power line ELVDDL. The light emitting diode LD may be an organic light emitting diode, an inorganic light emitting diode, a quantum dot light emitting diode, or the like.

The transistors T1, T2, T5, T6, and T7 may be P-type transistors. Channels of the transistors T1, T2, T5, T6, and T7 may be configured of poly silicon. A polysilicon transistor may be a low temperature poly silicon (LTPS) transistor. The polysilicon transistor has high electron mobility and thus the polysilicon transistor has a fast driving characteristic.

The transistors T3 and T4 may be N-type transistors. Channels of the transistors T3 and T4 may be configured of an oxide semiconductor. An oxide semiconductor transistor is capable of low temperature processing and has low charge mobility in comparison with polysilicon. Therefore, an amount of leakage current generated in a turn-off state of the oxide semiconductor transistors is smaller than that of polysilicon transistors.

According to some example embodiments, the transistor T7 may be configured of an N-type oxide semiconductor transistor instead of polysilicon. At this time, one of the scan lines GWNLn and GILn may be connected to the gate electrode of the transistor T7 by replacing the scan line GBLn.

Figure 4:
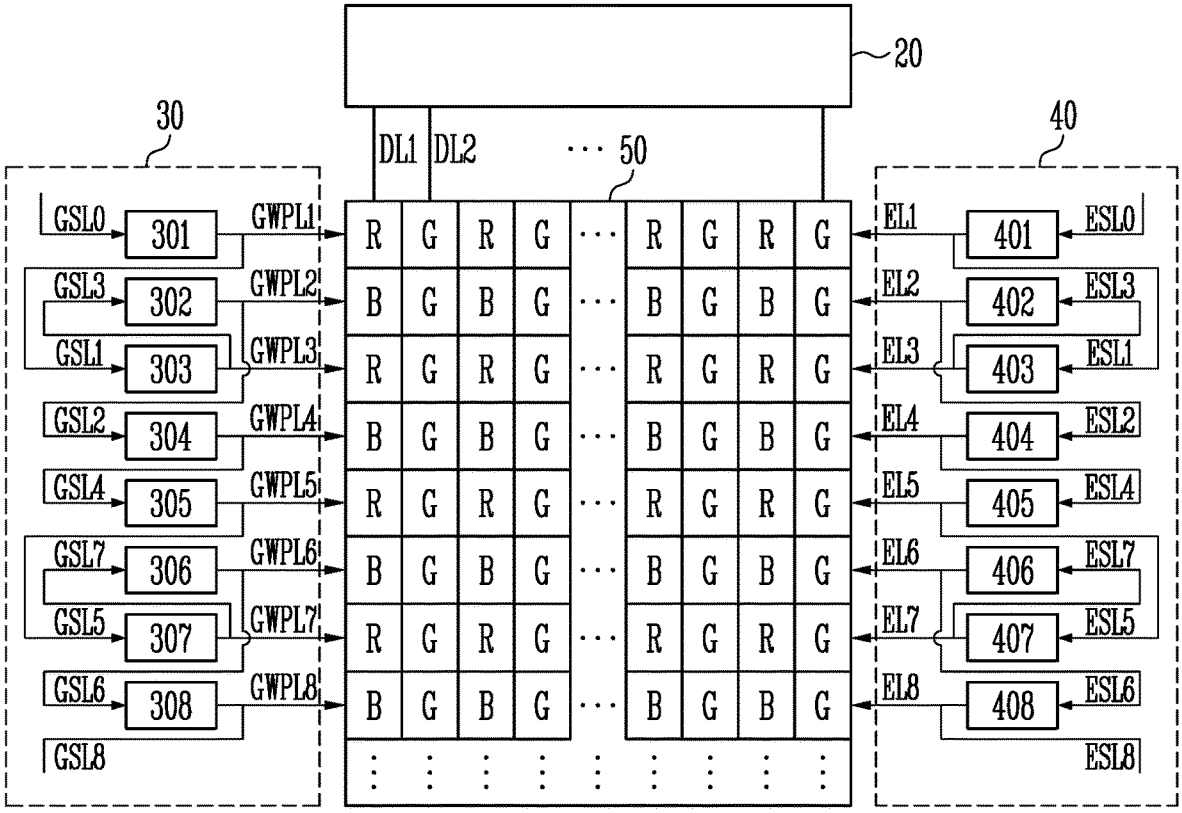
FIG. 4 is a block diagram illustrating a relationship between the data driver, the scan driver, the light emission driver, and a pixel unit (or display panel) in the display device according to some example embodiments of the disclosure.

FIG. 4 is a block diagram illustrating a relationship between the data driver, the scan driver, the light emission driver, and the pixel unit in the display device according to some example embodiments of the disclosure.

Referring to FIG. 4, the pixel unit 50 includes pixels arranged in a matrix form. That is, the pixels may be arranged in a row direction and a column direction. Here, the row direction may refer to a horizontal direction in the drawing, and the column direction may refer to a vertical direction in the drawing. However, the embodiments are not limited to the terms of the row direction and the column direction, the row direction and the column direction may be understood as intersecting relative directions. In FIG. 4, only a plurality of scan stages included in the first sub scan driver described above are shown, and the scan driver 30 will be described based on the first sub scan driver.

The pixels emit light of different colors. For example, among the pixels of FIG. 4, a pixel indicated by a symbol "R" is a red pixel emitting red light, a pixel indicated by "G" is a green pixel emitting green light, and a pixel indicated by a symbol "B" is a blue pixel emitting blue light.

In the present specification, a pixel row includes pixels located in the same row in the pixel unit 50 and arranged in the row direction. That is, the pixel row refers to pixels connected to the same scan line or light emission line. A pixel column includes pixels located in the same column in the pixel unit 50 and arranged in the column direction. That is, the pixel column refers to pixels connected to the same data line. For example, in the drawing, the red pixel R and the green pixel G may be alternately arranged in the row direction in a first pixel row, the blue pixel B and the green pixel G may be alternately arranged in the row direction in a second pixel row, the red pixel R and the blue pixel B may be alternately arranged in the column direction in a first pixel column, and only the green pixel G may be arranged in a second pixel column.

According to some example embodiments, the red pixel R and the blue pixel B may be connected to a (2p−1)-th (odd-numbered) data line, and the green pixel G may be connected to a 2p-th (even-numbered) data line. Here, p is a natural number. For example, the red pixel R and the blue pixel B may be connected to a first data line DL1, and the green pixel G may be connected to a second data line DL2. The red pixels R and the blue pixels B connected to the (2p−1)-th data line may be alternately arranged (e.g., may alternate) in the column direction. According to some example embodiments, the red pixel R and the blue pixel B may be connected to the 2p-th data line, and the green pixel G may be connected to the (2p−1)-th data line.

The data driver 20 may provide a data signal having a voltage level at which the red pixel R and the blue pixel B emit light to the (2p−1)-th data line. A voltage level of the data signal in a period in which the red pixel R does not emit light and the blue pixel B emits light may be greater than a voltage level of the data signal in a period in which the red pixel R emits light and the blue pixel B does not emit light. The voltage level of the data signal provided to the (2p−1)-th data line may swing (or change) in correspondence with whether the red pixel R and the blue pixel B emit light according to time (see, e.g., FIG. 6).

According to some example embodiments, the red pixel R and the green pixel G may be alternately arranged (e.g., may alternate) in the row direction in an odd-numbered pixel row of the pixel unit 50. The red pixel R and the green pixel G that are alternately arranged (e.g., alternate) in the row direction may be connected to (2p−1)-th scan lines GWPL1, GWPL3, GWPL5, and GWPL7. The blue pixel B and the green pixel G may be alternately arranged (e.g., may alternate) in the row direction in an even-numbered pixel row of the pixel unit 50. The blue pixels B and the green pixels G that are alternately arranged (e.g., may alternate) in the row direction may be connected to 2p-th scan lines GWPL2, GWPL4, GWPL6, and GWPL8.

Two adjacent pixels connected to the same data line (for example, the (2p−1)-th data line) and emitting light of different colors, and at least one green pixel G adjacent to any one of the two pixels is included in one unit pixel for displaying one unit image. For example, the red pixel R connected to the first data line DL1 and the first scan line GWPL1, the blue pixel B connected to the first data line DL1 and the second scan line GWPL2, the green pixel G connected to the second data line DL2 and the first scan line GWPL1, and the green pixel G connected to the second data line DL2 and the second scan line GWPL2 may form one unit pixel.

Hereinafter, the scan driver 30 and the light emission driver 40 will be described.

The scan driver 30 may include a plurality of scan stages 301 to 308 arranged in the column direction. For example, the first to eighth scan stages 301 to 308 may be sequentially arranged in the column direction.

Each of the scan stages 301 to 308 may be connected to scan start lines GSL0 to GSL8 and scan lines GWPL1 to GWPL8. The scan lines GWPL1 to GWPL8 may be connected to the pixels (pixel row) arranged in the row direction and to each of the scan stages 301 to 308. According to some example embodiments, the scan start lines GSL0 to GSL8 of the scan stages 301 to 308 may be connected to the scan controller 121 or may be branched from the scan lines GWPL1 to GWPL8 of the other scan stages 301 to 308.

For example, the first scan stage 301 may be connected to the initial scan start line GSL0 connected to the scan controller 121, and may be connected to the first scan line GWPL1 connected to the pixels located in the row direction in a first row of the pixel unit 50. The first scan start line GSL1 branched from the first scan line GWPL1 may be connected to the third scan stage 303.

The second scan stage 302 adjacent to the first scan stage 301 in the column direction may be connected to the third scan start line GSL3 branched from the third scan line GWPL3 of the third scan stage 303, and may be connected to the second scan line GWPL2 connected to a second pixel row of the pixel unit 50. The second scan start line GSL2 branched from the second scan line GWPL2 may be connected to the fourth scan stage 304. The second scan start line GSL2 branched from the second scan line GWPL2 may cross at least another wire to be connected to the fourth scan stage 304, and may be insulated from the other wire.

The third scan stage 303 adjacent to the second scan stage 302 in the column direction may be connected to the first scan start line GSL1 branched from the first scan line GWPL1 of the first scan stage 301, and may be connected to the third scan line GWPL3 connected to a third pixel row of the pixel unit 50. The third scan start line GSL3 branched from the third scan line GWPL3 may be connected to the second scan stage 302.

The fourth scan stage 304 adjacent to the third scan stage 303 in the column direction may be connected to the second scan start line GSL2 branched from the second scan line GWPL2 of the second scan stage 302, and may be connected to the fourth scan line GWPL4 connected to a fourth pixel row of the pixel unit 50. The fourth scan start line GSL4 branched from the fourth scan line GWPL4 may be connected to the fifth scan stage 305.

The fifth scan stage 305 adjacent to the fourth scan stage 304 in the column direction may be connected to the fourth scan start line GSL4 branched from the fourth scan line GWPL4 of the fourth scan stage 304, and may be connected to the fifth scan line GWPL5 connected to a fifth pixel row of the pixel unit 50. The fifth scan start line GSL5 branched from the fifth scan line GWPL5 may be connected to the seventh scan stage 307.

The sixth scan stage 306 adjacent to the fifth scan stage 305 in the column direction may be connected to the seventh scan start line GSL7 branched from the seventh scan line GWPL7 of the seventh scan stage 307, and may be connected to the sixth scan line GWPL6 connected to a sixth pixel row of the pixel unit 50. The sixth scan start line GSL6 branched from the sixth scan line GWPL6 may be connected to the eighth scan stage 308. The sixth scan start line GSL6 branched from the sixth scan line GWPL6 may cross with at least another wire to be connected to the eighth scan stage 308, and may be insulated from at least another wire.

The seventh scan stage 307 adjacent to the sixth scan stage 306 in the column direction may be connected to the fifth scan start line GSL5 branched from the fifth scan line GWPL5 of the fifth scan stage 305, and may be connected to the seventh scan line GWPL7 connected to a seventh pixel row of the pixel unit 50. The seventh scan start line GSL7 branched from the seventh scan line GWPL7 may be connected to the sixth scan stage 306.

The eighth scan stage 308 adjacent to the seventh scan stage 307 in the column direction may be connected to the sixth scan start line GSL6 branched from the sixth scan line GWPL6 of the sixth scan stage 306, and may be connected to the eighth scan line GWPL8 connected to an eighth pixel row of the pixel unit 50. According to some example embodiments, the eighth scan start line GSL8 branched from the eighth scan line GWPL8 may be connected to a ninth scan stage.

As described above, in the present embodiment, each of the scan stages 301 to 308, and each of the scan start lines GSL0 to GSL8 and each of the scan lines GWPL1 to GWPL8 connected to the respective scan stages 301 to 308 may be repeated regularly based on four scan stages. A fact that the first scan stage 301 is connected to the initial scan start line GSL0 connected to the scan controller 121 and there is no scan start line branched from the last scan line connected to the last scan stage may be an exception in the regulation.

For example, a (4p−3)-th scan stage adjacent to a (4p−4)-th scan stage in the column direction may be connected to a (4p−4)-th scan start line branched from a (4p−4)-th scan line of the (4p−4)-th scan stage, and may be connected to a (4p−3)-th scan line connected to a (4p−3)-th pixel row of the pixel unit 50. A (4p−3)-th scan start line branched from the (4p−3)-th scan line may be connected to a (4p−1)-th scan stage.

A (4p−2)-th scan stage adjacent to the (4p−3)-th scan stage in the column direction may be connected to a (4p−1)-th scan start line branched from a (4p−1)-th scan line of the (4p−1)-th scan stage, and may be connected to a (4p−2)-th scan line connected to a (4p−2)-th pixel row of the pixel unit 50. A (4p−2)-th scan start line branched from the (4p−2)-th scan line may be connected to a 4p-th scan stage. The (4p−2)-th scan start line branched from the (4p−2)-th scan line may cross with at least another wire to be connected to the 4p-th scan stage, and may be insulated from at least another wire.

The (4p−1)-th scan stage adjacent to the (4p−2)-th scan stage in the column direction may be connected to the (4p−3)-th scan start line branched from the (4p−3)-th scan line of the (4p−3)-th scan stage, and may be connected to the (4p−1)-th scan line connected to a (4p−1)-th pixel row of the pixel unit 50. The (4p−1)-th scan start line branched from the (4p−1)-th scan line may be connected to the (4p−2)-th scan stage.

The 4p-th scan stage adjacent to the (4p−1)-th scan stage in the column direction may be connected to the (4p−2)-th scan start line branched from the (4p−2)-th scan line of the (4p−2)-th scan stage, and may be connected to the 4p-th scan line connected to the 4p-th pixel row of the pixel unit 50. The 4p-th scan start line branched from the 4p-th scan line may be connected to the (4p+1)-th scan stage.

The light emission driver 40 may include a plurality of light emission stages 401 to 408 arranged in the column direction. For example, the first to eighth light emission stages 401 to 408 may be sequentially arranged in the column direction. According to some example embodiments, an arrangement or structure of the light emission stages 401 to 408 in the light emission driver 40 may be symmetrical with an arrangement form of the scan stages 301 to 308 in the scan driver 30 with respect to the pixel unit 50.

Each of the light emission stages 401 to 408 may be connected to light emission start lines ESL0 to ESL8 and light emission lines EL1 to EL8. The light emission lines EL1 to EL8 may be connected to the pixels arranged in the row direction and to each of the light emission stages 401 to 408. According to some example embodiments, the light emission start lines ESL0 to ESL8 of the light emission stages 401 to 408 may be connected to the scan controller 121 or may be branched from the light emission lines EL1 to EL8 of the other scan stages 401 to 408.

For example, the first light emission stage 401 may be connected to the initial light emission start line ESL0 connected to the scan controller 121, and may be connected to the first light emission line EL1 connected to the first pixel row of the pixel unit 50. The first light emission start line ESL1 branched from the first light emission line EL1 may be connected to the third light emission stage 403.

The second light emission stage 402 adjacent to the first light emission stage 401 in the column direction may be connected to the third light emission start line ESL3 branched from the third light emission line EL3 of the third light emission stage 403, and may be connected to the second light emission line EL2 connected to the second pixel row of the pixel unit 50. The second light emission start line ESL2 branched from the second light emission line EL2 may be connected to the fourth light emission stage 404. The second light emission start line ESL2 branched from the second light emission line EL2 may cross with at least another wire to be connected to the fourth light emission stage 404, and may be insulated from at least another wire.

The third light emission stage 403 adjacent to the second light emission stage 402 in the column direction may be connected to the first light emission start line ESL1 branched from the first light emission line EL1 of the first light emission stage 401, and may be connected to the third light emission line EL3 connected to the third pixel row of the pixel unit 50. The third light emission start line ESL3 branched from the third light emission line EL3 may be connected to the second light emission stage 402.

The fourth light emission stage 404 adjacent to the third light emission stage 403 in the column direction may be connected to the second light emission start line ESL2 branched from the second light emission line EL2 of the second light emission stage 402, and may be connected to the fourth light emission line EL4 connected to the fourth pixel row of the pixel unit 50. The fourth light emission start line ESL4 branched from the fourth light emission line EL4 may be connected to the fifth light emission stage 405.

The fifth light emission stage 405 adjacent to the fourth light emission stage 404 in the column direction may be connected to the fourth light emission start line ESL4 branched from the fourth light emission line EL4 of the fourth light emission stage 404, and may be connected to the fifth light emission line EL5 connected to the fifth pixel row of the pixel unit 50. The fifth light emission start line ESL5 branched from the fifth light emission line EL5 may be connected to the seventh light emission stage 407.

The sixth light emission stage 406 adjacent to the fifth light emission stage 405 in the column direction may be connected to the seventh light emission start line ESL7 branched from the seventh light emission line EL7 of the seventh light emission stage 407, and may be connected to the sixth light emission line EL6 connected to the sixth pixel row of the pixel unit 50. The sixth light emission start line ESL6 branched from the sixth light emission line EL6 may be connected to the eighth light emission stage 408. The sixth light emission start line ESL6 branched from the sixth light emission line EL6 may cross with at least another wire to be connected to the eighth light emission stage 408, and may be insulated from at least another wire.

The seventh light emission stage 407 adjacent to the sixth light emission stage 406 in the column direction may be connected to the fifth light emission start line ESL5 branched from the fifth light emission line EL5 of the fifth light emission stage 405, and may be connected to the seventh light emission line EL7 connected to the seventh pixel row of the pixel unit 50. The seventh light emission start line ESL7 branched from the seventh light emission line EL7 may be connected to the sixth light emission stage 406.

The eighth light emission stage 408 adjacent to the seventh light emission stage 407 in the column direction may be connected to the sixth light emission start line ESL6 branched from the sixth light emission line EL6 of the sixth light emission stage 406, and may be connected to the eighth light emission line EL8 connected to the eighth pixel row of the pixel unit 50. According to some example embodiments, the eighth light emission start line ESL8 branched from the eighth light emission line EL8 may be connected to a ninth light emission stage.

As described above, according to some example embodiments, each of the light emission stage 401 to 408, and each of the light emission start lines ESL0 to ESL8 and each of the light emission lines EL1 to EL8 connected to the respective light emission stages 401 to 408 may be repeated regularly based on four light emission stages. A fact that the first light emission stage 401 is connected to the initial light emission start line ESL0 connected to the scan controller 121 and there is no light emission start line branched from the last light emission line connected to the last light emission stage may be an exception in the regulation.

For example, a (4p−3)-th light emission stage adjacent to a (4p−4)-th light emission stage in the column direction may be connected to a (4p−4)-th light emission start line branched from a (4p−4)-th light emission line of the (4p−4)-th light emission stage, and may be connected to a (4p−3)-th light emission line connected to the (4p−3)-th pixel row of the pixel unit 50. A (4p−3)-th light emission start line branched from the (4p−3)-th light emission line may be connected to a (4p−1)-th light emission stage.

A (4p−2)-th light emission stage adjacent to the (4p−3)-th light emission stage in the column direction may be connected to a (4p−1)-th light emission start line branched from a (4p−1)-th light emission line of the (4p−1)-th light emission stage, and may be connected to a (4p−2)-th light emission line connected to the (4p−2)-th pixel row of the pixel unit 50. A (4p−2)-th light emission start line branched from the (4p−2)-th light emission line may be connected to a 4p-th light emission stage. The (4p−2)-th light emission start line branched from the (4p−2)-th light emission line may cross with at least another wire to be connected to the 4p-th light emission stage, and may be insulated from at least another wire.

The (4p−1)-th light emission stage adjacent to the (4p−2)-th light emission stage in the column direction may be connected to the (4p−3)-th light emission start line branched from the (4p−3)-th light emission line of the (4p−3)-th light emission stage, and may be connected to the (4p−1)-th light emission line connected to the (4p−1)-th pixel row of the pixel unit 50. The (4p−1)-th light emission start line branched from the (4p−1)-th light emission line may be connected to the (4p−2)-th light emission stage.

The 4p-th light emission stage adjacent to the (4p−1)-th light emission stage in the column direction may be connected to the (4p−2)-th light emission start line branched from the (4p−2)-th light emission line of the (4p−2)-th light emission stage, and may be connected to the 4p-th light emission line connected to the 4p-th pixel row of the pixel unit 50. The 4p-th light emission start line branched from the 4p-th light emission line may be connected to the (4p+1)-th light emission stage.

Hereinafter, the scan signal and the light emission signal will be described in more detail with reference to FIG. 5.

Figure 5:
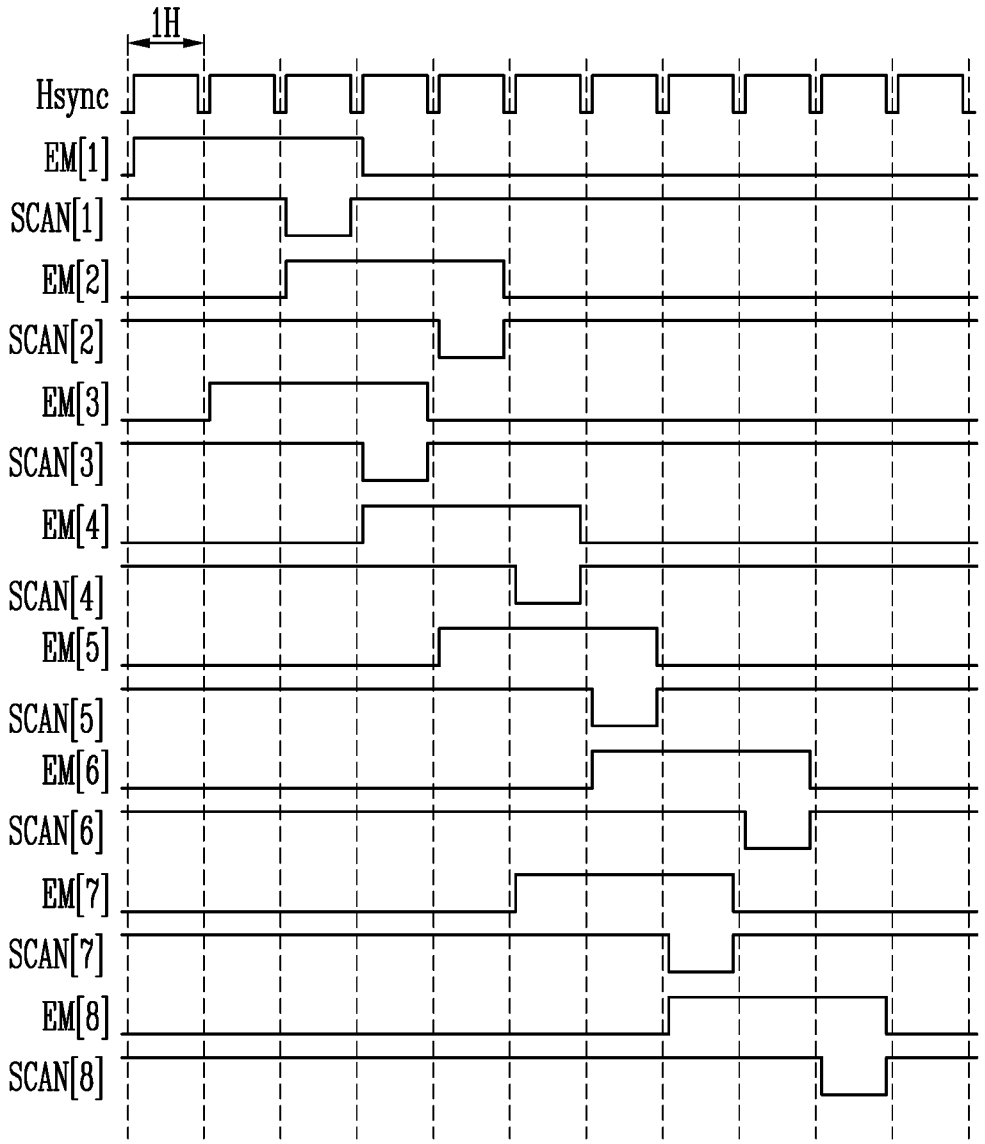
FIG. 5 is a timing diagram illustrating a scan signal and a light emission signal supplied to each pixel row from each scan line and each light emission line of FIG. 4.

FIG. 5 is a timing diagram illustrating the scan signal and the light emission signal supplied to each pixel row from each scan line and each light emission line of FIG. 4. In FIG. 5, a low level signal of the scan signal is a turn-on level, and a high level signal of the light emission signal is a turn-off level. Similarly, in FIG. 4, the description will be given based on the scan signal supplied from the first sub scan driver.

In the first pixel row, a scan signal SCAN[1] is supplied to the first scan line GWPL1, and a light emission signal EM[1] is supplied to the first light emission line EL1. In the second pixel row, a scan signal SCAN[2] is supplied to the second scan line GWPL2, and a light emission signal EM[2] is supplied to the second light emission line EL2. In the third pixel row, a scan signal SCAN[3] is supplied to the third scan line GWPL3, and a light emission signal EM[3] is supplied to the third light emission line EL3. In the fourth pixel row, a scan signal SCAN[4] is supplied to the fourth scan line GWPL4, and a light emission signal EM[4] is supplied to the fourth light emission line EL4. In the fifth pixel row, a scan signal SCAN[5] is supplied to the fifth scan line GWPL5, and a light emission signal EM[5] is supplied to the fifth light emission line EL5. In the sixth pixel row, a scan signal SCAN[6] is supplied to the sixth scan line GWPL6, and a light emission signal EM[6] is supplied to the sixth light emission line EL6. In the seventh pixel row, a scan signal SCAN[7] is supplied to the seventh scan line GWPL7, and a light emission signal EM[7] is supplied to the seventh light emission line EL7. In the eighth pixel row, a scan signal SCAN[8] is supplied to the eighth scan line GWPL8, and a light emission signal EM[8] is supplied to the eighth light emission line EL8.

According to some example embodiments, the scan signal of the turn-on level and the light emission signal of the turn-off level may be transmitted in an interlace manner rather than a progressive manner in which the scan signal and the light emission signal are transmitted to each pixel row in correspondence with an arrangement order.

First, the first scan stage 301 and the first light emission stage 401 may receive the scan start signal and a light emission off signal from the scan controller 121, respectively, and may supply the scan signal of the turn-on level and the light emission signal of the turn-off level to the first pixel row through the first scan line GWPL1 and the first light emission line EL1. A period in which the scan signal of the turn-on level is supplied in each pixel row may be included in a period in which the light emission signal of the turn-off level is supplied. That is, the supply of the light emission signal of the turn-off level may be maintained in the period in which the scan signal of the turn-on level is supplied in each pixel row.

Next, the third light emission stage 403, which receives the light emission off signal through the first light emission start line ESL1 branched from the first light emission line EL1, may supply the light emission signal of the turn-off level to the third pixel row through the third light emission line EL3. The third scan stage 303, which receives the scan start signal through the first scan start line GSL1 branched from the first scan line GWPL1, may supply the scan signal of the turn-on level to the third pixel row through the third scan line GWPL3.

Next, the second light emission stage 402, which receives the light emission off signal through the third light emission start line ESL3 branched from the third light emission line EL3, may supply the light emission signal of the turn-off level to the second pixel row through the second light emission line EL2. The second scan stage 302, which receives the scan start signal through the third scan start line GSL3 branched from the third scan line GWPL3, may supply the scan signal of the turn-on level to the second pixel row through the second scan line GWPL2.

Next, the fourth light emission stage 404, which receives the light emission off signal through the second light emission start line ESL2 branched from the second light emission line EL2, may supply the light emission signal of the turn-off level to the fourth pixel row through the fourth light emission line EL4. The fourth scan stage 304, which receives the scan start signal through the second scan start line GSL2 branched from the second scan line GWPL2, may supply the scan signal of the turn-on level to the fourth pixel row through the fourth scan line GWPL4.

Next, the fifth light emission stage 405, which receives the light emission off signal through the fourth light emission start line ESL4 branched from the fourth light emission line EL4, may supply the light emission signal of the turn-off level to the fifth pixel row through the fifth light emission line EL5. The fifth scan stage 305, which receives the scan start signal through the fourth scan start line GSL4 branched from the fourth scan line GWPL4, may supply the scan signal of the turn-on level to the fifth pixel row through the fifth scan line GWPL5.

Next, the seventh light emission stage 407, which receives the light emission off signal through the fifth light emission start line ESL5 branched from the fifth light emission line EL5, may supply the light emission signal of the turn-off level to the seventh pixel row through the seventh light emission line EL7. The seventh scan stage 307, which receives the scan start signal through the fifth scan start line GSL5 branched from the fifth scan line GWPL5, may supply the scan signal of the turn-on level to the seventh pixel row through the seventh scan line GWPL7.

Next, the sixth light emission stage 406, which receives the light emission off signal through the seventh light emission start line ESL7 branched from the seventh light emission line EL7, may supply the light emission signal of the turn-off level to the sixth pixel row through the sixth light emission line EL6. The sixth scan stage 306, which receives the scan start signal through the seventh scan start line GSL7 branched from the seventh scan line GWPL7, may supply the scan signal of the turn-on level to the sixth pixel row through the sixth scan line GWPL6.

Next, the eighth light emission stage 408, which receives the light emission off signal through the sixth light emission start line ESL6 branched from the sixth light emission line EL6, may supply the light emission signal of the turn-off level to the eighth pixel row through the eighth light emission line EL8. The eighth scan stage 308, which receives the scan start signal through the sixth scan start line GSL6 branched from the sixth scan line GWPL6, may supply the scan signal of the turn-on level to the eighth pixel row through the eighth scan line GWPL8.

As described above, an order in which the scan signal of the turn-on level and the light emission signal of the turn-off level are provided for each pixel row may be repeated regularly based on four pixel rows. A time point at which the light emission signal of the turn-off level is provided to each pixel row may be an order of the first pixel row, the third pixel row, the second pixel row, the fourth pixel row, the fifth pixel row, the seventh pixel row, the sixth pixel row, the eighth pixel row, . . . . Similarly, a time point at which the scan signal of the turn-on level is provided to each pixel row may be an order of the first pixel row, the third pixel row, the second pixel row, the fourth pixel row, the fifth pixel row, the seventh pixel row, the sixth pixel row, the eighth pixel row . . . .

According to some example embodiments, periods in which the light emission signal of the turn-off level is provided to each pixel row may overlap. In addition, periods in which the scan signal of the turn-on level is provided to each pixel row may not overlap. The period in which the light emission signal of the turn-off level is provided in each pixel may be three times or more than the period in which the scan signal of the turn-on level is provided.

Figure 6:
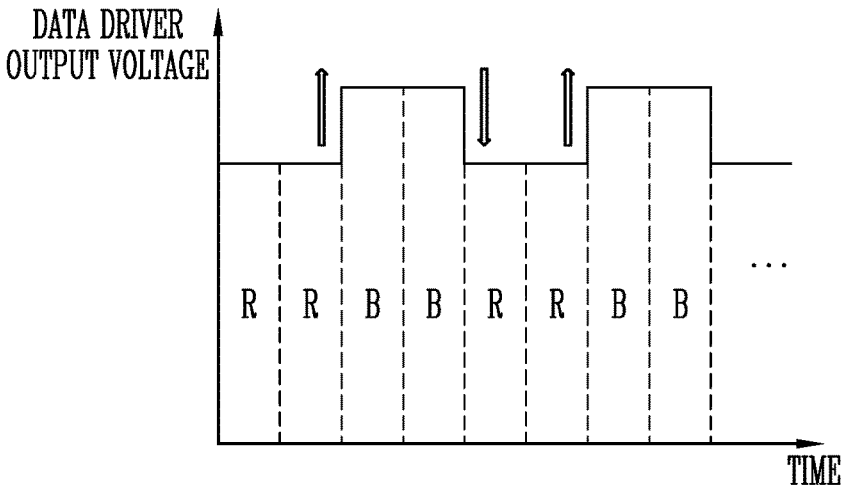
FIG. 6 is a graph illustrating an output voltage of the data driver versus time in the display device according to some example embodiments of the disclosure.

FIG. 6 is a graph illustrating an output voltage of the data driver versus time in the display device according to some example embodiments of the disclosure.

Referring to FIG. 6, the output voltage of the data driver 20 may be different according to a state of the red pixel R and the blue pixel B connected to the (2p−1)-th data line.

According to some example embodiments, when the scan signal of the turn-on level is supplied to a scan line connected to an odd-numbered scan row based on the first data line DL1, the red pixel R may emit light. When the scan signal of the turn-on level is supplied to a scan line connected to an even-numbered scan row, the blue pixel B may emit light. When the blue pixel B emits light, the voltage level of the data signal output from the data driver 20 may be larger than that when the red pixel R emits light.

Because the time point at which the scan signal of the turn-on level is provided to each pixel row is the order of the first pixel row, the third pixel row, the second pixel row, the fourth pixel row, the fifth pixel row, the seventh pixel row, the sixth pixel row, the eighth pixel row, . . . , the red pixel R of the first pixel row, the red pixel R of the third pixel row, the blue pixel B of the second pixel row, the blue pixel B of the fourth pixel row, the red pixel R of the fifth pixel row, the red pixel R of the seventh pixel row, the blue pixel B of the sixth pixel row, and the blue pixel B of the eighth pixel row may sequentially emit light, in correspondence therewith. When a light emission state of the red pixel R has ended and a light emission state of the blue pixel B has started, the voltage level of the data signal output from the data driver 20 may increase. When the light emission state of the blue pixel B has ended and the light emission state of the red pixel R has started, the voltage level of the data signal output from the data driver 20 may decrease. As described above, the voltage level of the data signal output from the data driver 20 may swing according to the light emission states of the red pixel R and the blue pixel B.

Meanwhile, when the voltage level of the data signal output from the data driver 20 swings, power may be largely consumed. In contrast to a structure in which one red pixel R and one blue pixel B alternately emit light, according to some example embodiments, because two red pixels R and two blue pixels B alternately emit light, the number of swings may be nearly halved. That is, the power consumption due to the swing may be halved.

According to some example embodiments, the number of swings per one frame may be equal to or less than half of the number of pixel rows included in the pixel unit 50. For example, when the pixel unit 50 is an FHD (1920*1080) resolution having 1920 pixel rows, the number of swings may be 959.

In addition, according to some example embodiments, the order in which the scan signal of the turn-on level is provided to each pixel and the order in which the light emission signal of the turn-off level is provided to each pixel correspond with each other, and thus a period in which the light emission signal of the turn-off level is provided may be easily controlled.

Next, the display device according to some example embodiments will be described in more detail. Hereinafter, description of the same components as those of FIGS. 1 to 6 will be omitted, and the same or similar reference numerals are used for the same components as those of FIGS. 1 to 6.

Figure 7:
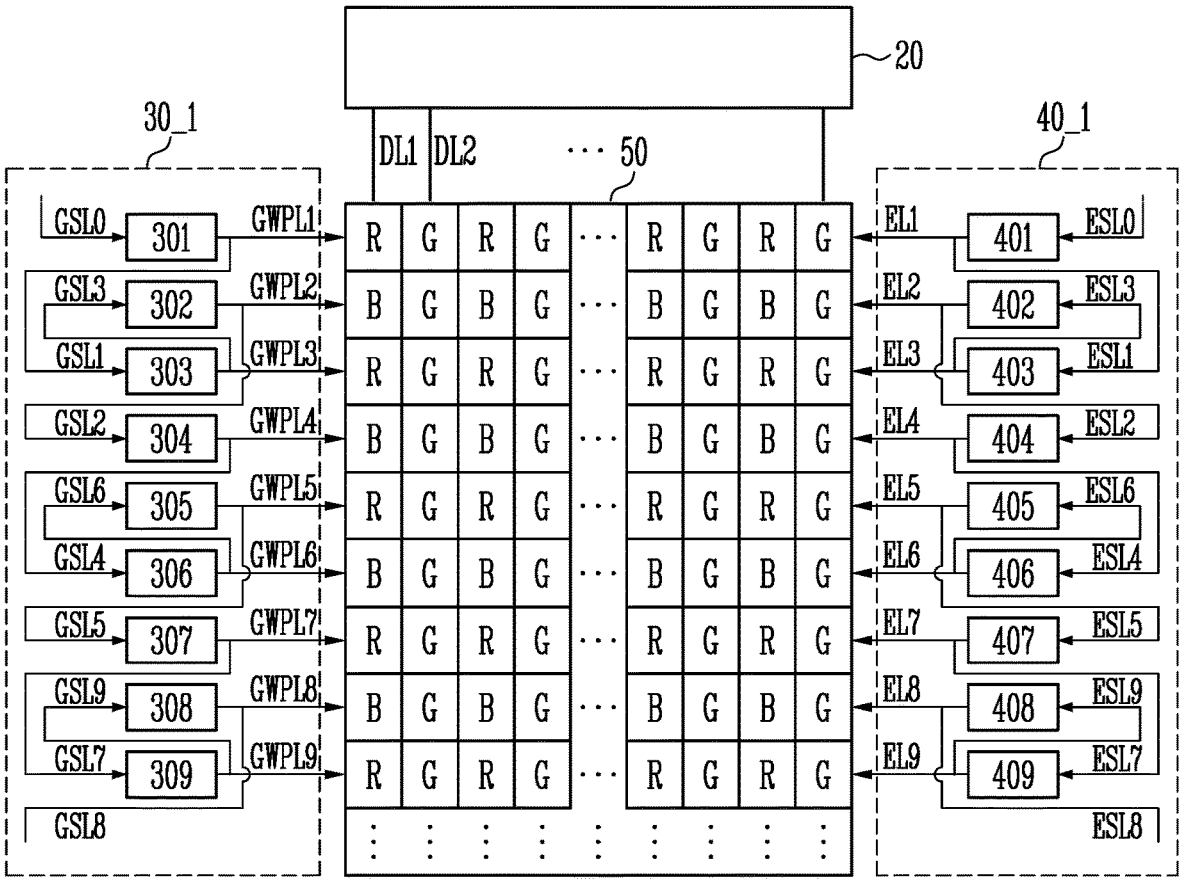
FIG. 7 is a block diagram illustrating a relationship between the data driver, the scan driver, the light emission driver, and the pixel unit in the display device according to some example embodiments of the disclosure.
Figure 8:
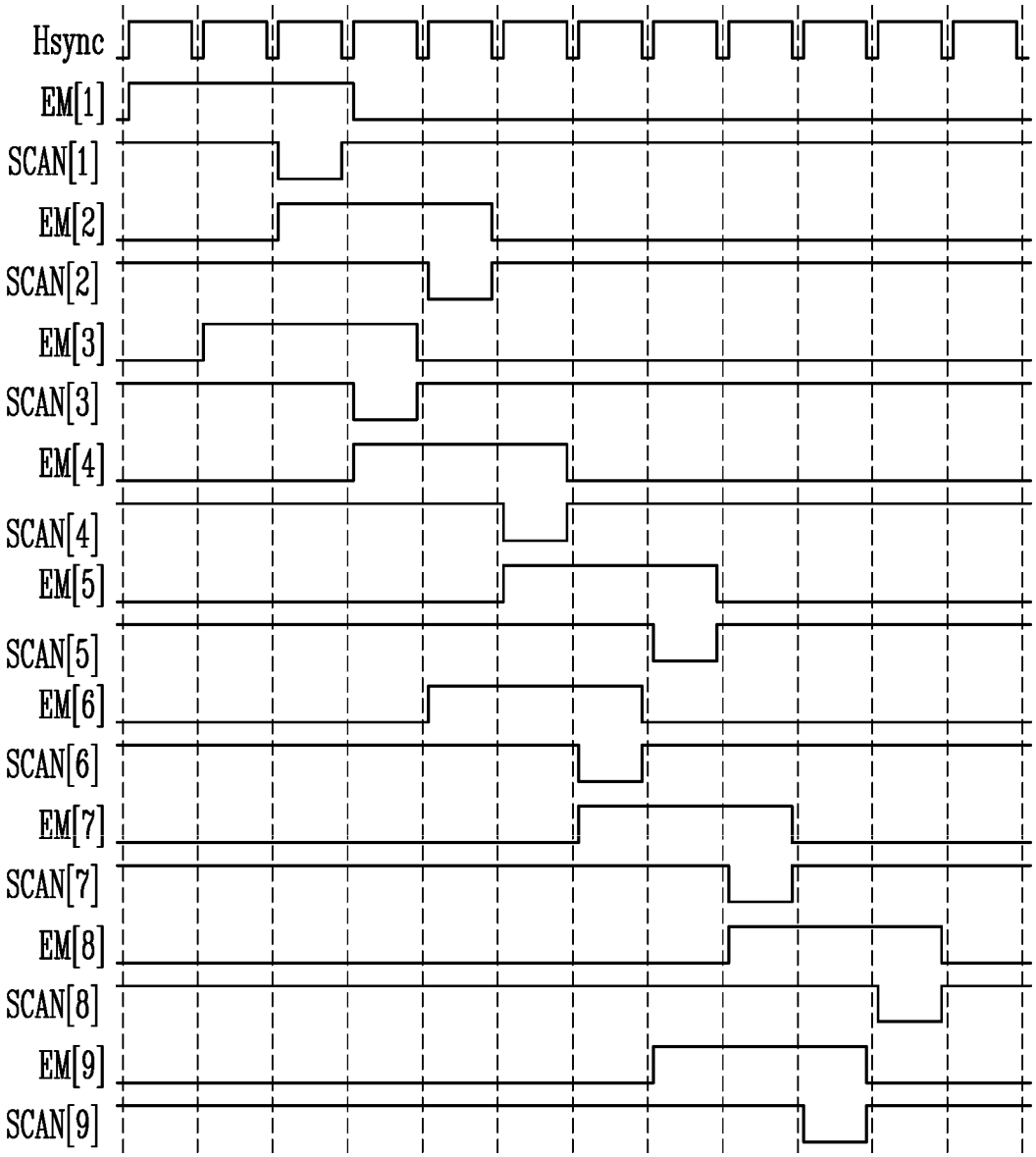
FIG. 8 is a timing diagram illustrating the scan signal and the light emission signal supplied to each pixel row from each scan line and each light emission line of FIG. 7.
Figure 9:
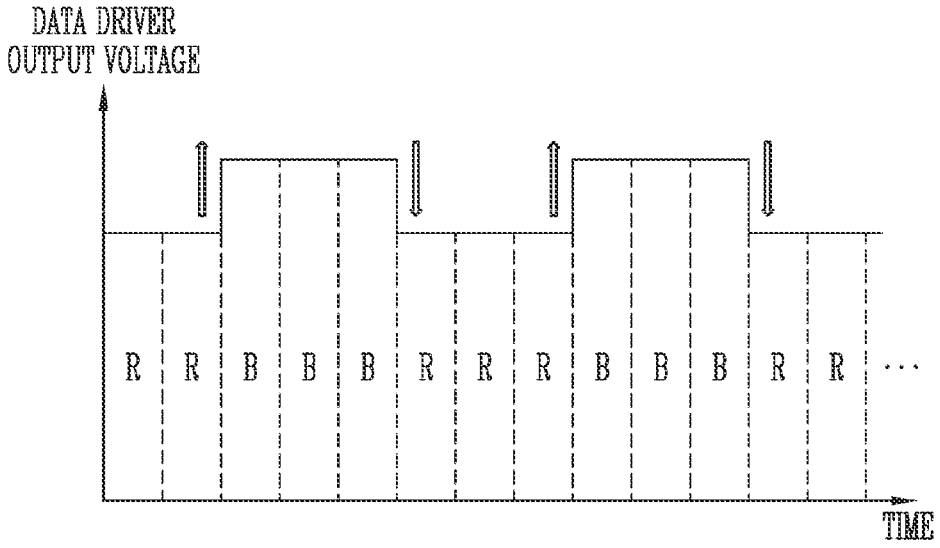
FIG. 9 is a graph illustrating the output voltage of the data driver versus time in the display device of FIG. 7.

FIG. 7 is a block diagram illustrating a relationship between the data driver, the scan driver, the light emission driver, and the pixel unit in the display device according to some example embodiments. FIG. 8 is a timing diagram illustrating the scan signal and the light emission signal supplied to each pixel row from each scan line and each light emission line of FIG. 7. FIG. 9 is a graph illustrating the output voltage of the data driver versus time in the display device of FIG. 7.

Referring to FIGS. 7 to 9, the display device according to some example embodiments has a difference in that the red pixel R or the blue pixel B included in one pixel column successively emits light three times, in comparison with the embodiment of FIGS. 4 to 6. The scan driver 30_1 may include a plurality of scan stages 301 to 309 arranged in the column direction, and the light emission driver 40_1 may include a plurality of light emission stages 401 to 409 arranged in the column direction.

First, the first scan stage 301 and the first light emission stage 401 may receive the scan start signal and the light emission off signal from the scan controller 121, respectively, and may supply the scan signal of the turn-on level and the light emission signal of the turn-off level to the first pixel row through the first scan line GWPL1 and the first light emission line EL1.

Next, the third light emission stage 403, which receives the light emission off signal through the first light emission start line ESL1 branched from the first light emission line EL1, may supply the light emission signal of the turn-off level to the third pixel row through the third light emission line EL3. The third scan stage 303, which receives the scan start signal through the first scan start line GSL1 branched from the first scan line GWPL1, may supply the scan signal of the turn-on level to the third pixel row through the third scan line GWPL3.

Next, the second light emission stage 402, which receives the light emission off signal through the third light emission start line ESL3 branched from the third light emission line EL3, may supply the light emission signal of the turn-off level to the second pixel row through the second light emission line EL2. The second scan stage 302, which receives the scan start signal through the third scan start line GSL3 branched from the third scan line GWPL3, may supply the scan signal of the turn-on level to the second pixel row through the second scan line GWPL2.

Next, the fourth light emission stage 404, which receives the light emission off signal through the second light emission start line ESL2 branched from the second light emission line EL2, may supply the light emission signal of the turn-off level to the fourth pixel row through the fourth light emission line EL4. The fourth scan stage 304, which receives the scan start signal through the second scan start line GSL2 branched from the second scan line GWPL2, may supply the scan signal of the turn-on level to the fourth pixel row through the fourth scan line GWPL4.

Next, the sixth light emission stage 406, which receives the light emission off signal through the fourth light emission start line ESL4 branched from the fourth light emission line EL4, may supply the light emission signal of the turn-off level to the sixth pixel row through the sixth light emission line EL6. The sixth scan stage 306, which receives the scan start signal through the fourth scan start line GSL4 branched from the fourth scan line GWPL4, may supply the scan signal of the turn-on level to the sixth pixel row through the sixth scan line GWPL6.

Next, the fifth light emission stage 405, which receives the light emission off signal through the sixth light emission start line ESL6 branched from the sixth light emission line EL6, may supply the light emission signal of the turn-off level to the fifth pixel row through the fifth light emission line EL5. The fifth scan stage 305, which receives the scan start signal through the sixth scan start line GSL6 branched from the sixth scan line GWPL6, may supply the scan signal of the turn-on level to the fifth pixel row through the fifth scan line GWPL5.

Next, the seventh light emission stage 407, which receives the light emission off signal through the fifth light emission start line ESL5 branched from the fifth light emission line EL5, may supply the light emission signal of the turn-off level to the seventh pixel row through the seventh light emission line EL7. The seventh scan stage 307, which receives the scan start signal through the fifth scan start line GSL5 branched from the fifth scan line GWPL5, may supply the scan signal of the turn-on level to the seventh pixel row through the seventh scan line GWPL7.

Next, the ninth light emission stage 409, which receives the light emission off signal through the seventh light emission start line ESL7 branched from the seventh light emission line EL7, may supply the light emission signal of the turn-off level to the ninth pixel row through the ninth light emission line EL9. The ninth scan stage 309, which receives the scan start signal through the seventh scan start line GSL7 branched from the seventh scan line GWPL7, may supply the scan signal of the turn-on level to the ninth pixel row through the ninth scan line GWPL9.

Next, the eighth light emission stage 408, which receives the light emission off signal through the ninth light emission start line ESL9 branched from the ninth light emission line EL9, may supply the light emission signal of the turn-off level to the eighth pixel row through the eighth light emission line EL8. The eighth scan stage 308, which receives the scan start signal through the ninth scan start line GSL9 branched from the ninth scan line GWPL9, may supply the scan signal of the turn-on level to the eighth pixel row through the eighth scan line GWPL8.

As described above, the order in which the scan signal of the turn-on level and the light emission signal of the turn-off level are provided for each pixel row may be repeated regularly based on six pixel rows from the second pixel row. The time point at which the light emission signal of the turn-off level is provided to each pixel row may be in an order of a first pixel row, a third pixel row, a second pixel row, a fourth pixel row, a sixth pixel row, a fifth pixel row, a seventh pixel row, a ninth pixel row, an eighth pixel row, . . . . Similarly, the time point at which the scan signal of the turn-on level is provided to each pixel row may be in an order of the first pixel row, the third pixel row, the second pixel row, the fourth pixel row, the sixth pixel row, the fifth pixel row, the seventh pixel row, the ninth pixel row, the eighth pixel row, . . . .

Because the time point at which the scan signal of the turn-on level is provided to each pixel row may be the order of the first pixel row, the third pixel row, the second pixel row, the fourth pixel row, the sixth pixel row, the fifth pixel row, the seventh pixel row, the ninth pixel row, the eighth pixel row, . . . , the red pixel R of the first pixel row, the red pixel R of the third pixel row, the blue pixel B of the second pixel row, the blue pixel B of the fourth pixel row, the blue pixel B of the sixth pixel row, the red pixel R of the fifth pixel row, the red pixel R of the seventh pixel row, the red pixel R of the ninth pixel row, and the blue pixel B of the eighth pixel row may sequentially emit light, in correspondence therewith.

In contrast to the case where one red pixel R and one blue pixel B alternately emit light, in the present embodiment, because three red pixels R and three blue pixels B alternately emit light, the number of swings may be reduced to nearly one-third. That is, power consumption due to swing may be reduced.

According to some example embodiments, the number of swings per one frame may be equal to or less than one-third of the number of pixel rows included in the pixel unit 50. For example, when the pixel unit 50 is an FHD (1920*1080) resolution having 1920 pixel rows, the number of swings may be 640.

Figure 10:
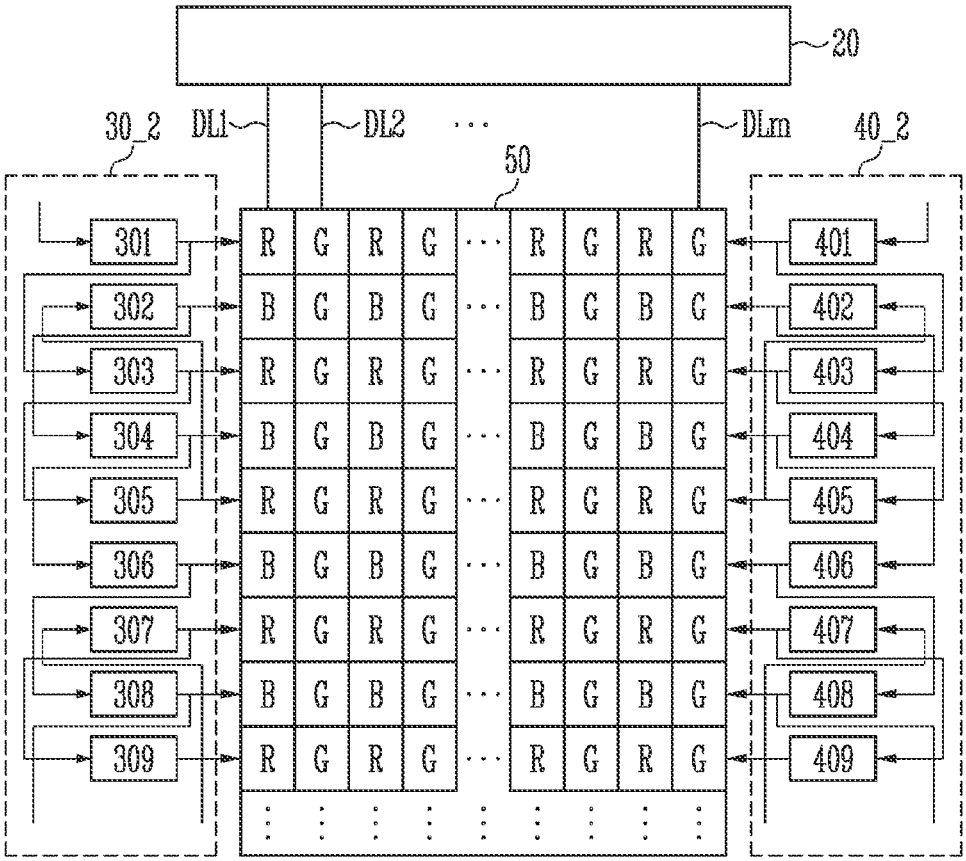
FIG. 10 is a block diagram illustrating a relationship between the data driver, the scan driver, the light emission driver, and the pixel unit in the display device according to some example embodiments of the disclosure.
Figure 11:
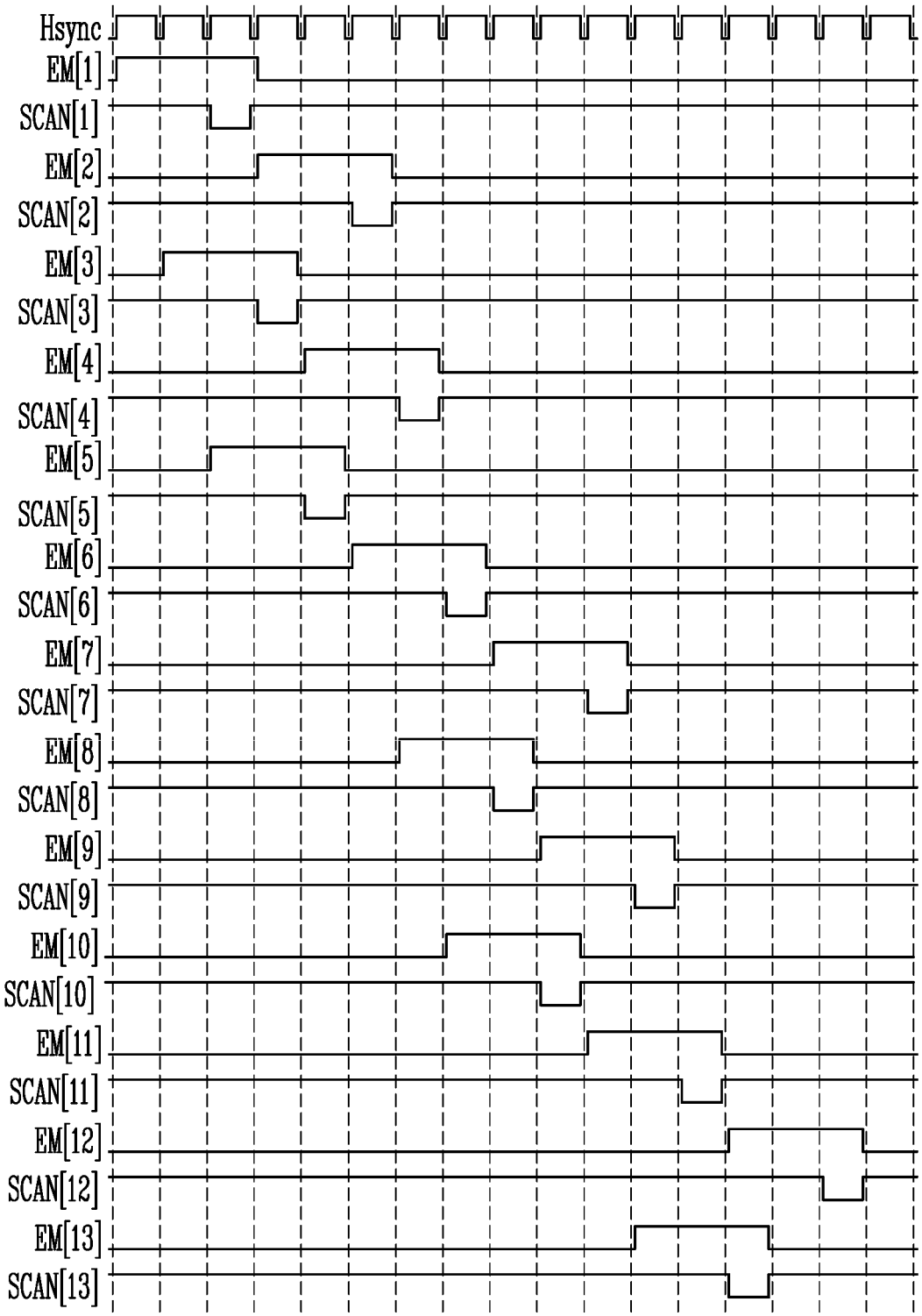
FIG. 11 is a timing diagram illustrating the scan signal and the light emission signal supplied to each pixel row from each scan line and each light emission line of FIG. 10.
Figure 12:
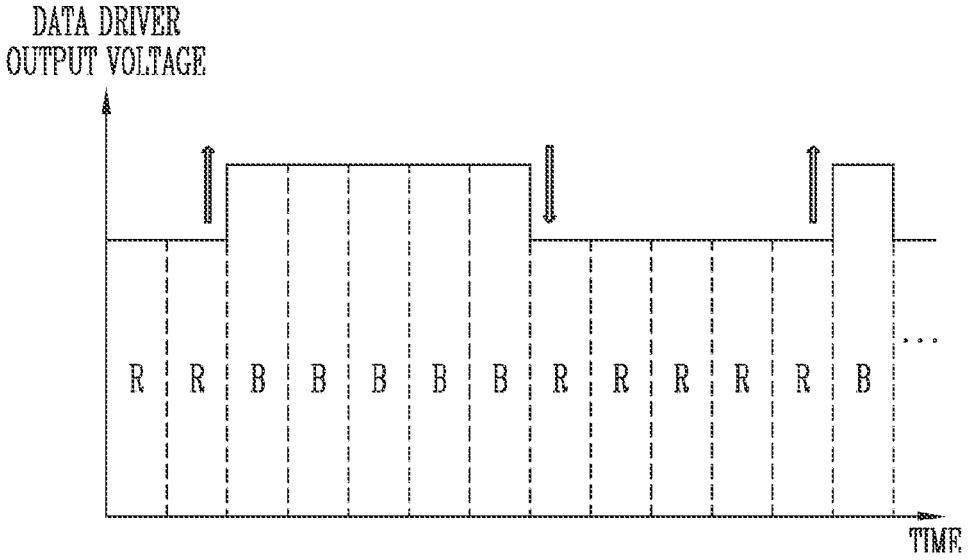
FIG. 12 is a graph illustrating the output voltage of the data driver versus time in the display device of FIG. 10.

FIG. 10 is a block diagram illustrating a relationship between the data driver, the scan driver, the light emission driver, and the pixel unit in the display device according to some example embodiments. FIG. 11 is a timing diagram illustrating the scan signal and the light emission signal supplied to each pixel row from each scan line and each light emission line of FIG. 10. FIG. 12 is a graph illustrating the output voltage of the data driver versus time in the display device of FIG. 10.

Referring to FIGS. 10 to 12, the display device according to the present embodiment has a difference in that the red pixel R or the blue pixel B included in one pixel column successively emits light five times, in comparison with the embodiments according to FIGS. 4 to 6. The scan driver 30_2 may include a plurality of scan stages 301 to 309 arranged in the column direction, and the light emission driver 40_2 may include a plurality of light emission stages 401 to 409 arranged in the column direction.

The order in which the scan signal of the turn-on level and the light emission signal of the turn-off level are provided for each pixel row may be repeated regularly based on ten pixel rows from the second pixel row. The time point at which the light emission signal of the turn-off level is provided to each pixel row may be an order of a first pixel row, a third pixel row, a fifth pixel row, a second pixel row, a fourth pixel row, a sixth pixel row, an eighth pixel row, a tenth pixel row, a seventh pixel row, a ninth pixel row, an eleventh pixel row, a thirteenth pixel line, a fifteenth pixel row, a twelfth pixel row, a fourteenth pixel row, . . . . Similarly, the time point at which the scan signal of the turn-on level is provided to each pixel row may be an order of the first pixel row, the third pixel row, the fifth pixel row, the second pixel row, the fourth pixel row, the sixth pixel row, the eighth pixel row, the tenth pixel row, the seventh pixel row, the ninth pixel row, the eleventh pixel row, the thirteenth pixel line, the fifteenth pixel row, the twelfth pixel row, the fourteenth pixel row, . . . .

Because the time point at which the scan signal of the turn-on level is provided to each pixel row may be the order of first pixel row, the third pixel row, the fifth pixel row, the second pixel row, the fourth pixel row, the sixth pixel row, the eighth pixel row, the tenth pixel row, the seventh pixel row, the ninth pixel row, the eleventh pixel row, the thirteenth pixel line, the fifteenth pixel row, the twelfth pixel row, the fourteenth pixel row, . . . , the red pixel R of the first pixel row, the red pixel R of the third pixel row, the red pixel R of the fifth pixel row, the blue pixel B of the second pixel row, the blue pixel B of the fourth pixel row, the blue pixel B of the sixth pixel row, the blue pixel B of the eighth pixel row, the blue pixel B of the tenth pixel row, the red pixel R of the seventh pixel row, the red pixel R of the ninth pixel row, the red pixel R of the eleventh pixel row, the red pixel R of the thirteenth pixel row, the red pixel R of the fifteenth pixel row, the blue pixel B of the twelfth pixel row, and the blue pixel B of the fourteenth pixel row may sequentially emit light, in correspondence therewith.

In contrast to the case where one red pixel R and one blue pixel B alternately emit light, in the present embodiment, because five red pixels R and five blue pixels B alternately emit light, the number of swings may be reduced to nearly one-fifth. That is, power consumption due to swing (e.g., a voltage variation or swing) may be reduced.

According to some example embodiments, the number of swings per one frame may be equal to or less than one-fifth of the number of pixel rows included in the pixel unit 50. For example, when the pixel unit 50 is an FHD (1920*1080) resolution having 1920 pixel rows, the number of swings may be 384.

Figure 13:
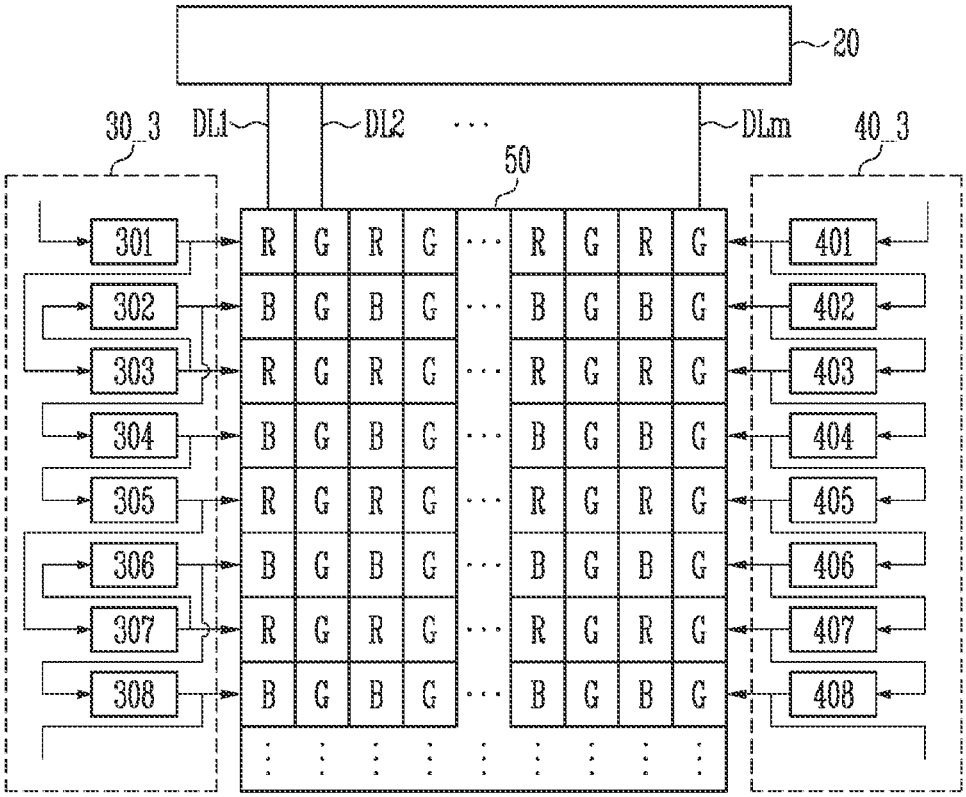
FIG. 13 is a block diagram illustrating a relationship between the data driver, the scan driver, the light emission driver, and the pixel unit in the display device according to some example embodiments of the disclosure.
Figure 14:
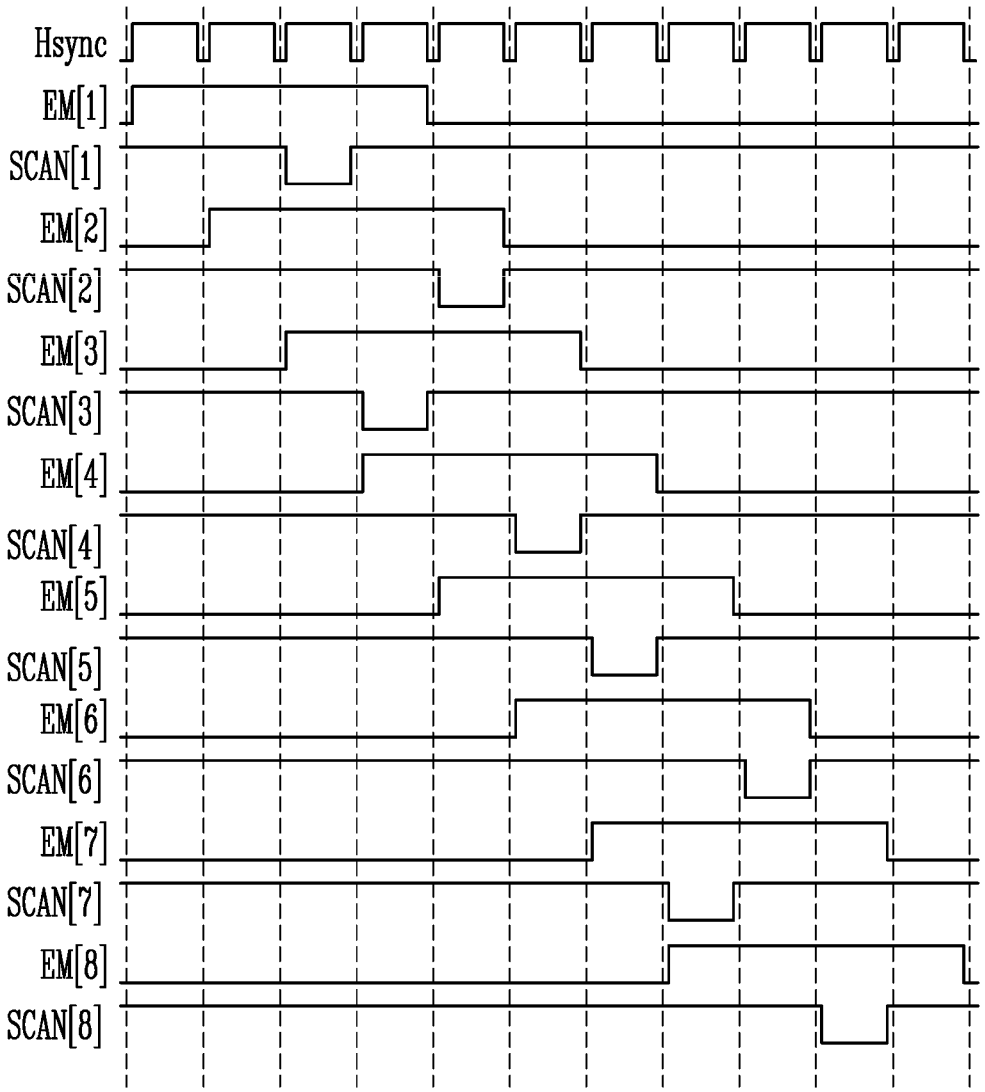
FIG. 14 is a timing diagram illustrating the scan signal and the light emission signal supplied to each pixel row from each scan line and each light emission line of FIG. 13.

FIG. 13 is a block diagram illustrating a relationship between the data driver, the scan driver, the light emission driver, and the pixel unit in the display device according to some example embodiments. FIG. 14 is a timing diagram illustrating the scan signal and the light emission signal supplied to each pixel row from each scan line and each light emission line of FIG. 13.

Referring to FIGS. 13 and 14, the display device according to the present embodiment has a difference in that the light emission signal of the turn-off level is provided in a progressive manner in which the light emission signal of the turn-off level is transmitted to each pixel row in correspondence with an arrangement order, in comparison compared with the embodiment of FIGS. 4 and 5. The scan driver 30_3 may include a plurality of scan stages 301 to 308 arranged in the column direction, and the light emission driver 40_3 may include a plurality of light emission stages 401 to 408 arranged in the column direction.

Because the time point at which the scan signal of the turn-on level is provided to each pixel row is an order of a first pixel row, a third pixel row, a second pixel row, a fourth pixel row, a fifth pixel row, a seventh pixel row, and a sixth pixel row, an eighth pixel row, . . . , the red pixel R of the first pixel row, the red pixel R of the third pixel row, the blue pixel B of the second pixel row, the blue pixel B of the fourth pixel row, the red pixel R of the fifth pixel row, the red pixels R of the seventh pixel row, the blue pixel B of the sixth pixel row, and the blue pixel B of the eighth pixel row may sequentially emit light.

Meanwhile, the time point at which the light emission signal of the turn-off level is provided to each pixel row may be an order of the first pixel row, the second pixel row, the third pixel row, the fourth pixel row, the fifth pixel row, the sixth pixel row, the seventh pixel row, the eighth pixel row, . . . .

The period in which the light emission signal of the turn-off level is provided to each pixel may be four times or more than the period in which the scan signal of the turn-on level is provided.

Although some example embodiments of the disclosure have been described with reference to the accompanying drawings, it will be understood by those skilled in the art to which the disclosure pertains that the embodiments may be implemented in other specific forms without departing from the technical spirit and scope of embodiments according to the present disclosure, as defined in the claims and their equivalents. Therefore, it should be understood that the embodiments described above are illustrative and are not restrictive in all aspects.

What is claimed is:

1. A display device comprising:

a display panel including a plurality of pixels arranged in a row direction and a column direction;

a data driver configured to transmit a data signal to the plurality of pixels through a plurality of data lines;

a scan driver configured to transmit a scan signal to the plurality of pixels through a plurality of scan lines; and a light emission driver configured to transmit a light emission signal to the plurality of pixels through a plurality of light emission lines, wherein each of the plurality of scan lines and the plurality of light emission lines is connected to pixels arranged in the row direction among the plurality of pixels, the plurality of data lines are connected to pixels arranged in the column direction among the plurality of pixels, and the scan driver is configured to transmit the scan signal of a turn-on level to the display panel in an interlace manner, wherein red pixels and blue pixels are connected to one data line among the plurality of data lines, and the red pixels and the blue pixels alternate in the column direction such that each red pixel from among the red pixels is directly adjacent to a corresponding blue pixel from among the blue pixels, and wherein the data driver is configured to successively transmit the data signal to at least two red pixels or at least two blue pixels connected to the one data line, sequentially, such that the at least two red pixels and the at least two blue pixels alternately emit light.

2. The display device according to claim 1, wherein the light emission driver is configured to transmit the light emission signal of a turn-off level to the pixels arranged in the row direction, and the scan signal of the turn-on level is transmitted to the pixels arranged in the row direction while the transmission of the light emission signal of the turn-off level is maintained.

3. The display device according to claim 2, wherein the light emission driver is configured to transmit the light emission signal of the turn-off level in an interlace manner.

4. The display device according to claim 2, wherein a period in which the transmission of the light emission signal of the turn-off level is maintained in each of the plurality of pixels is three times or more than a period in which the scan signal of the turn-on level is maintained.

5. The display device according to claim 1, wherein the scan signal of the turn-on level is provided in an order of pixels arranged in a first row, pixels arranged in a third row, pixels arranged in a second row, and pixels arranged in a fourth row, among the plurality of pixels.

6. The display device according to claim 5, wherein the light emission signal of a turn-off level is provided in an order of the pixels arranged in the first row, the pixels arranged in the third row, the pixels arranged in the second row, and the pixels arranged in the fourth row, among the plurality of pixels.

7. The display device according to claim 1 wherein green pixels are connected to another data line among the plurality of data lines.

8. The display device according to claim 1 wherein the data driver is configured to transmit swinging data signals of different levels to the one data line, and the data signals of the different levels swing less than half of a number of rows of the plurality of pixels per one frame.

9. The display device according to claim 1, wherein the scan driver includes a plurality of scan stages connected to a scan start line and each of the scan lines, and each of the scan stages is configured to supply the scan signal of the turn-on level to the pixels connected to each of the scan lines in response to a scan start signal provided to the scan start line.

10. The display device according to claim 9, wherein the plurality of scan stages comprises:

a first scan stage connected to pixels arranged in a first row among the plurality of pixels through a first scan line;

a second scan stage connected to pixels arranged in a second row among the plurality of pixels through a second scan line; and a third scan stage connected to pixels arranged in a third row among the plurality of pixels through a third scan line, and the third scan stage is connected to a scan start line branched from the first scan line.

11. The display device according to claim 10, wherein the second scan stage is connected to a scan start line branched from the third scan line.

12. The display device according to claim 1, wherein the light emission driver is configured to transmit the light emission signal of a turn-off level in a progressive manner.

13. A display device comprising:

a data line;

a plurality of red pixels and a plurality of blue pixels connected to the data line; and a plurality of scan lines connected to the plurality of red pixels and the plurality of blue pixels to provide a scan signal, and a plurality of light emission lines for providing a light emission signal, wherein the plurality of red pixels and the plurality of blue pixels are alternately arranged along the data line such that each red pixel from among the plurality of red pixels is directly adjacent to a corresponding blue pixel from among the plurality of blue pixels, and the scan signal is successively provided to at least two red pixels sequentially, and then successively provided to at least two blue pixels, sequentially, such that the at least two red pixels and the at least two blue pixels alternately emit light.

14. The display device according to claim 13, wherein the scan signals successively provided to the at least two red pixels do not overlap in time.

15. The display device according to claim 14, wherein the light emission signals provided to the at least two red pixels overlap at least partially in time.

16. The display device according to claim 15, wherein the light emission signals provided to the at least two red pixels are successively provided.

17. The display device according to claim 13, wherein each of the pixels includes seven transistors, a storage capacitor, and a light emitting diode.

* * * * *